US008059069B2

(12) United States Patent
Shin et al.

(10) Patent No.: US 8,059,069 B2
(45) Date of Patent: Nov. 15, 2011

(54) ORGANIC LIGHT EMITTING DIODE DISPLAY DEVICE AND DRIVING METHOD THEREOF

(75) Inventors: Hye-jin Shin, Suwon-si (KR); Jin-hyun Choi, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 980 days.

(21) Appl. No.: 12/007,451

(22) Filed: Jan. 10, 2008

(65) Prior Publication Data

US 2008/0204375 A1 Aug. 28, 2008

(30) Foreign Application Priority Data

Feb. 23, 2007 (KR) ..... 10-2007-0018696

(51) Int. Cl.
*G09G 3/30* (2006.01)

(52) U.S. Cl. ..... 345/77; 345/82

(58) Field of Classification Search ..... 345/76–89, 345/690, 694, 695; 315/169.1–169.3; 313/483–512
See application file for complete search history.

(56) References Cited

U.S. PATENT DOCUMENTS

| | | | | |
|---|---|---|---|---|
| 5,315,694 | A * | 5/1994 | Kasano | 345/591 |
| 5,428,265 | A | 6/1995 | Booth Jr. et al. | |
| 6,809,718 | B2 | 10/2004 | Wei et al. | |
| 6,823,083 | B1 * | 11/2004 | Watanabe et al. | 382/167 |
| 7,019,762 | B2 | 3/2006 | Yoshihara et al. | |
| 2001/0050757 | A1 | 12/2001 | Yoshida et al. | |
| 2003/0231160 | A1 | 12/2003 | Yosihara et al | |
| 2004/0196303 | A1 * | 10/2004 | Matsuda | 345/690 |
| 2004/0222999 | A1 * | 11/2004 | Choi et al. | 345/589 |
| 2005/0073516 | A1 * | 4/2005 | Kang | 345/204 |
| 2005/0087671 | A1 | 4/2005 | Park | |
| 2006/0244697 | A1 | 11/2006 | Lee et al. | |
| 2007/0040774 | A1 * | 2/2007 | Lee et al. | 345/77 |
| 2007/0165048 | A1 | 7/2007 | Yamashita et al. | |
| 2007/0188623 | A1 | 8/2007 | Yamashita et al. | |

FOREIGN PATENT DOCUMENTS

| | | | |
|---|---|---|---|
| CN | 1324066 | A | 11/2001 |
| CN | 1 467 553 | A | 1/2004 |
| CN | 1467553 | A | 1/2004 |
| CN | 1855202 | A | 11/2006 |
| JP | 2004-020747 | A | 1/2004 |
| JP | 2004-325748 | A | 11/2004 |
| JP | 2004-354635 | A | 12/2004 |
| JP | 2005-134866 | A | 5/2005 |

(Continued)

*Primary Examiner* — Chanh Nguyen
*Assistant Examiner* — Pegeman Karimi
(74) *Attorney, Agent, or Firm* — Lee & Morse, P.C.

(57) ABSTRACT

An organic light emitting diode (OLED) display device, including a pixel unit including a plurality of pixels connected to scan lines and data lines, a scan driver adapted to generate and supply scan signals to the scan lines, a data driver adapted to generate and supply data signals to the data lines, an optical sensor adapted to generate an optical sensor signal to correspond to an intensity of light, and a data conversion unit adapted to compare a predetermined reference value with the optical sensor signal so as to generate a selection signal for selecting one of at least three modes. The data conversion unit may be adapted to store an input image data or a changing data changed from the input image data to correspond with the selection signal. The data driver may generate the data signals to correspond to the input image data or the changing data stored in the data conversion unit.

14 Claims, 4 Drawing Sheets

FOREIGN PATENT DOCUMENTS

| | | | |
|---|---|---|---|
| JP | 2006-243454 | A | 9/2006 |
| JP | 2006-337997 | A | 12/2006 |
| JP | 2006-350316 | A | 12/2006 |
| KR | 10-1990-0003762 | | 3/1990 |
| KR | 10-54440 | B1 | 9/1992 |
| KR | 10-2005-0011297 | | 1/2005 |
| KR | 10-2006-0113009 | A | 11/2006 |
| KR | 10-2006-0120643 | A | 11/2006 |

* cited by examiner

FIG. 3A $$A\begin{bmatrix} R_{in} \\ G_{in} \\ B_{in} \end{bmatrix} = \begin{bmatrix} R_s \\ G_s \\ B_s \end{bmatrix}$$

FIG. 3B $$A = \begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}$$

FIG. 3C $$\begin{bmatrix} 0.299+0.701\times k & 0.587\times(1-k) & 0.114\times(1-k) \\ 0.299\times(1-k) & 0.587+0.413\times k & 0.114\times(1-k) \\ 0.299\times(1-k) & 0.587\times(1-k) & 0.114+0.886\times k \end{bmatrix}\begin{bmatrix} R_{in} \\ G_{in} \\ B_{in} \end{bmatrix} = \begin{bmatrix} R_s \\ G_s \\ B_s \end{bmatrix}$$

FIG. 3D $$\begin{bmatrix} 0.299 & 0.587 & 0.114 \\ 0.299 & 0.587 & 0.114 \\ 0.299 & 0.587 & 0.114 \end{bmatrix}\begin{bmatrix} R_{in} \\ G_{in} \\ B_{in} \end{bmatrix} = \begin{bmatrix} R_s \\ G_s \\ B_s \end{bmatrix}$$

ORGANIC LIGHT EMITTING DIODE DISPLAY DEVICE AND DRIVING METHOD THEREOF

BACKGROUND OF THE INVENTION

1. Field of the Invention

Example embodiments relate to an organic light emitting diode (OLED) display device and driving methods thereof and, more particularly, to an OLED display device having improved display and visibility across varying ambient light conditions and driving methods thereof.

2. Description of the Related Art

Various flat display technologies, i.e., plasma display panels (PDPs), liquid crystal displays (LCDs) and OLED displays, are becoming widely used over other display devices, e.g., cathode ray tubes (CRTs), due to its small size, reduced weight and volume and energy efficiency characteristics. In comparing the various flat display technologies, however, the OLED displays may provide better luminance feature and color purity because OLED displays use an organic compound as an emitting material. Further, due to its reduced size and weight, the OLED displays may be incorporated into portable display devices, e.g., cellular phones, personal digital assistant devices, portable multimedia players and the like. Since the portable display devices may be exposed to varying light conditions, e.g., exposed to outdoor visible light, quality and visibility (or viewability) of images displayed on the portable display device may be diminished. In other words, brightness of images displayed on the portable display device may be diminished (or faded out) under light, e.g., solar light, because surrounding or ambient light and/or illumination intensity may be brighter than the brightness of the displayed image.

Therefore, there is a need for the development of an OLED display having improved display and visibility across varying ambient light conditions, and methods of driving such devices.

SUMMARY OF THE INVENTION

Example embodiments are therefore related to an OLED display device and driving methods thereof, which substantially overcome one or more of the problems due to the limitations and disadvantages of the related art.

It is therefore a feature of example embodiments to provide an OLED display device having improved display and visibility across varying ambient light conditions.

At least one of the above and other features of example embodiments may provide an OLED display device. The OLED display device may include a pixel unit having a plurality of pixels connected to scan lines and data lines, a scan driver adapted to generate and supply scan signals to the scan lines, a data driver adapted to generate and supply data signals to the data lines, an optical sensor adapted to generate an optical sensor signal corresponding to an intensity of light, and a data conversion unit adapted to compare a predetermined reference value with the optical sensor signal so as to generate a selection signal for selecting one of at least three modes. The data conversion unit may be adapted to store an input image data or a changed input image data to correspond with the selection signal. The data driver may be adapted to generate the data signals to correspond to the input image data or the changed input image data stored in the data conversion unit.

The data conversion unit may further include a comparator, a control unit adapted to determine changing the input image data to correspond to the selection signal, a first operator unit adapted to generate a pixel saturation data to correspond to the input image data transmitted from the control unit, a second operator unit adapted to extract the changed input image data to correspond to the pixel saturation data and the selection signal, and a memory adapted to store the input image data transmitted from the control unit or the changed input image data supplied from the second operator unit.

In a first mode, the control unit may be adapted to store the input image data in the memory if the selection signal indicates a weak intensity of light. In a second mode, the control unit may be adapted to transmit the input image data to the first operator unit and adapted to transmit the selection signal to the second operator unit if the selection signal indicates a large intensity of light. In a third mode, the control unit may be adapted to transmit the input image data to the first operator unit and adapted to transmit the selection signal to the second operator unit if the selection signal indicates a value between the weak intensity of light and the large intensity of light. The changed input image data in the third mode may be set to a lower value than the second mode.

The first operator unit may be adapted to perform an operation using a saturation variable matrix. The first operator unit may be adapted to calculate a desired saturation data in every subpixel by performing an operation on an input data in the input image data and the saturation variable matrix in every subpixel.

The OLED display device may further include a reference look-up table unit calculated by the second operator unit. The reference look-up table unit may include a first saturation and luminance look-up tables and a second saturation and luminance look-up tables. The second operator unit may be adapted to select one of the first saturation and luminance look-up tables and the second saturation and luminance look-up tables to correspond to the pixel saturation data and the selection signal. The second operator unit may be adapted to extract the changed input image data from the selected look-up tables. The second operator unit may be adapted to extract the changed input image data by linearly interpolating between two values of the pixel saturation data stored in the reference look-up table unit, if the pixel saturation data that is not stored in the reference look-up table unit is input.

At least one of the above and other features of example embodiments may provide a method for driving an OLED display device. The method may include supplying scan signals to scan lines generated by a scan driver, supplying data signals to data lines generated by a data driver, generating an optical sensing signal corresponding to an intensity of light sensed on an optical sensor, generating a selection signal for selecting one of at least three modes to correspond to the intensity of light, and storing an input image data or a changed input image data to correspond with the selection signal. The data driver may generate the data signals to correspond to the input image data or the changed input image data stored in a data conversion unit.

The method may further include determining whether to change the input image data to correspond to the selection signal, and extracting data when the changed input image data is determined. The changed data may be obtained by changing at least one of a saturation and a luminance of the input image data. The extracted changed input image data may further include generating a pixel saturation data from the input image data, and extracting the changed input image data from a reference look-up table unit to correspond to the pixel saturation data and the selection signal. The generated pixel saturation data may further include calculating a desired saturation data in every subpixel by performing an operation on the input image data and the saturation variable matrix, and generating the pixel saturation data to correspond to the desired saturation data in every subpixel.

The method may further include extracting the changed input image data by linearly interpolating between two values of the pixel saturation data among values stored in the reference look-up table unit if the pixel saturation data not stored in the reference look-up table unit is input.

The method may further include selecting a signal for selecting a mode in the selection signal corresponding to a weak intensity of light, so that the input image data may remain unchanged. The method may further include selecting a signal for selecting a mode in the selection signal corresponding to a large intensity of light, so as to change the input image data.

The method may further include storing the input image data and generating a data signal corresponding to the stored input image data.

BRIEF DESCRIPTION OF THE DRAWINGS

The above and other features and advantages of the example embodiments will become more apparent to those of ordinary skill in the art by describing in detail example embodiments thereof with reference to the attached drawings, of which:

FIG. 3A to FIG. 3D illustrate matrices of a desired saturation data in a subpixel calculated in a first operator unit by using a saturation variable matrix as shown in FIG. 2.

DETAILED DESCRIPTION OF THE INVENTION

Korean Patent Application No. 10-2007-0018696, filed on Feb. 23, 2007, in the Korean Intellectual Property Office, and entitled: "Organic Light Emitting Diodes Display Device and Driving Method Thereof," is incorporated by reference herein in its entirety.

Example embodiments will now be described more fully hereinafter with reference to the accompanying drawings; however, the example embodiments may be embodied in different forms and should not be construed as limited to the embodiments set forth herein. Rather, these example embodiments are provided so that this disclosure will be thorough and complete, and will fully convey the scope of the invention to those skilled in the art.

Figure 1:
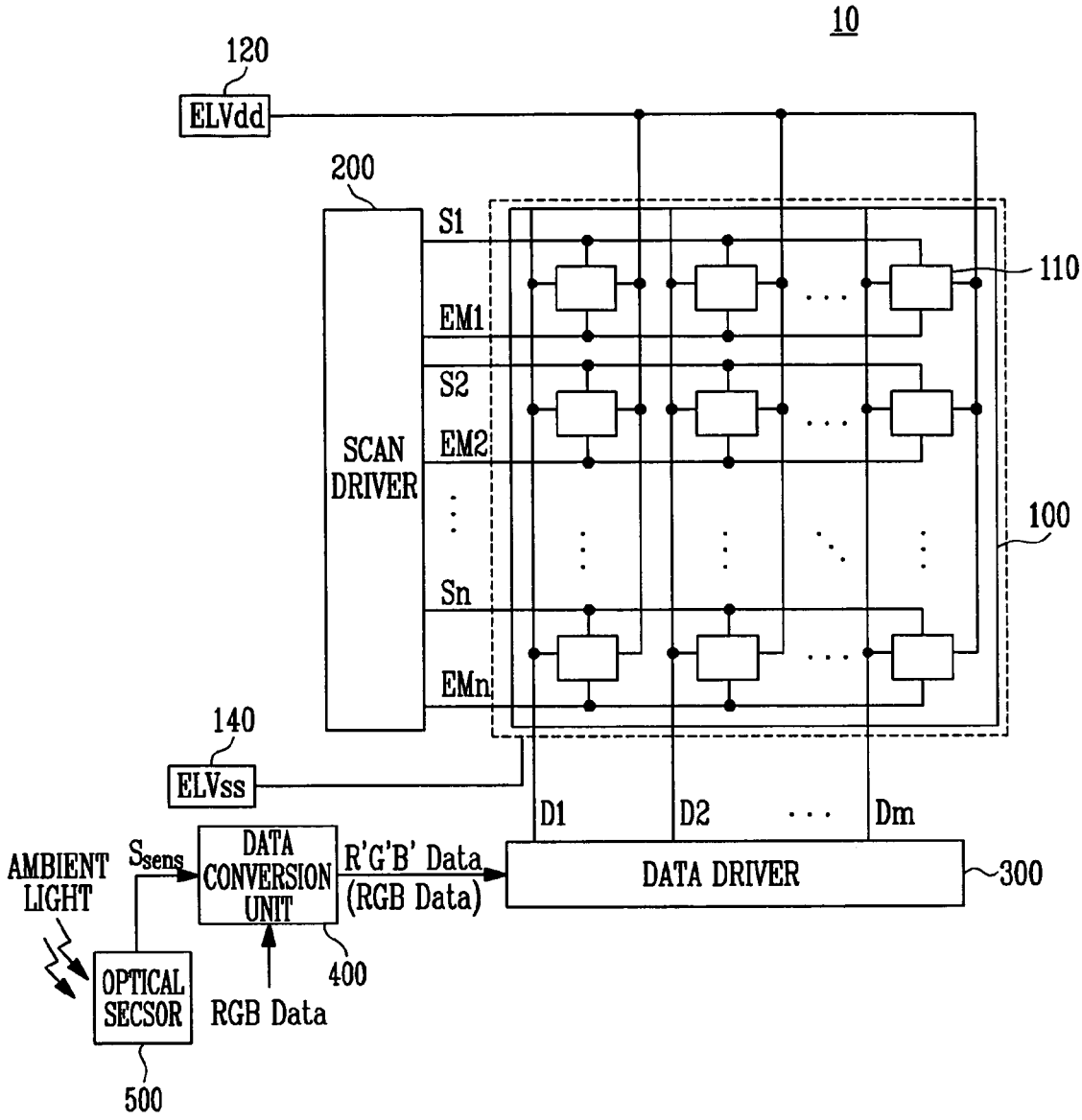
FIG. 1 illustrates a schematic view of an OLED display device according to an example embodiment.

Referring to FIG. 1, an OLED display device 10 may include a pixel unit 100, a scan driver 200, a data driver 300, a data conversion unit 400 and an optical sensor 500. Other devices and/or elements may be included or excluded in the OLED display device 10.

The pixel unit 100 may include a plurality of pixels 110 connected to scan lines (S1 to Sn), light emission control lines (EM1 to EMn) and data lines (D1 to Dm). Further, a single pixel 110 may have one OLED and may be composed of at least two subpixels for emitting different color light, e.g., red, green and blue.

The pixel unit 100 may display an image to correspond to a first power source (ELVdd) 120 supplied from an outside and a second power source (ELVss) 140 supplied from the outside. The pixel unit 100 may also display images corresponding to scan signals supplied by the scan lines S1 to Sn and light emission control signals supplied by the emission control lines EM1 to EMn generated from the scan driver 200, and data signals supplied by the data lines D1 to Dm generated from the data driver 300.

The scan driver 200 may generate the scan signals and the light emission control signals. The scan signals generated in the scan driver 200 may be sequentially supplied to the scan lines (S1 to Sn) and the light emission control signals may be sequentially supplied to each of the light emission control lines (EM1 to EMn). The scan signals and the emission control signals may also be non-sequentially supplied to the scan lines S1 to Sn and the emission control lines EM1 to EMn, respectively.

The data driver 300 may receive an image data (R'G'B' Data or RGB Data) converted by the control unit 400 and may generate data signals corresponding to the received image data. The data signals generated in the data driver 300 may be supplied to the pixels 110 through the data lines (D1 to Dm) to synchronize with the scan signal. The data signals may also be supplied to the data lines D1 to Dm in a non-synchronization manner with the scan signal.

The optical sensor 500 may include an optical sensor element, e.g., a transistor or a photodiode, to sense an intensity of ambient light. The optical sensor 500 may also generate an optical sensor signal (Ssens) corresponding to the sensed intensity of ambient light. The optical sensor signal (Ssens) generated in the optical sensor 500 may then be supplied to the data conversion unit 400.

The data conversion unit 400 may compare a predetermined reference value with the optical sensor signal (Ssens) to generate a selection signal (Ssel) for selecting one of at least three modes, e.g., a first intensity light mode, a second intensity light mode and a third intensity light mode. Further, the data conversion unit 400 may store an initial input image data (RGB Data) or a changed input image data (R'G'B' Data). The initial input image data (RGB Data) may be a signal indicating no change to the input image data (RGB Data) when the signal in the selection signal corresponds to a weak intensity of ambient light. The changed input image data (R'G'B' Data) may be a signal indicating a change to the initial input image data (RGB Data) when the signal in the selection signal corresponds to a large intensity of ambient light, e.g., a greater illumination intensity value than the predetermined reference value. Further, the data conversion unit 400 may generate the changed input image data (R'G'B' Data) so as to control the saturation and/or luminance of the initial input image data (RGB Data) and, thus, enhance visibility. Further, when the changed input image data (R'G'B' Data) is generated, the data conversion unit 400 may provide an improved respond to light intensity by selecting different modes, e.g., modes to control the initial input image data (RGB Data) corresponding to the optical sensor signal (Ssens).

The data conversion unit 400 may also perform other operations. For example, determining whether or not to change the initial input image data (RGB Data), generating the changed data (R'G'B' Data) according to the saturation and/or luminance value of the initial input image data (RGB Data) and/or storing the generated changed input image data (R'G'B' Data).

The selection signal (Ssel) generated in the data conversion unit 400 may then be input to the data driver 300. In particular, the initial input image data (RGB Data) or the changed input image data (R'G'B' Data) stored in the data conversion unit 400 may be input to the data driver 300.

Figure 2:
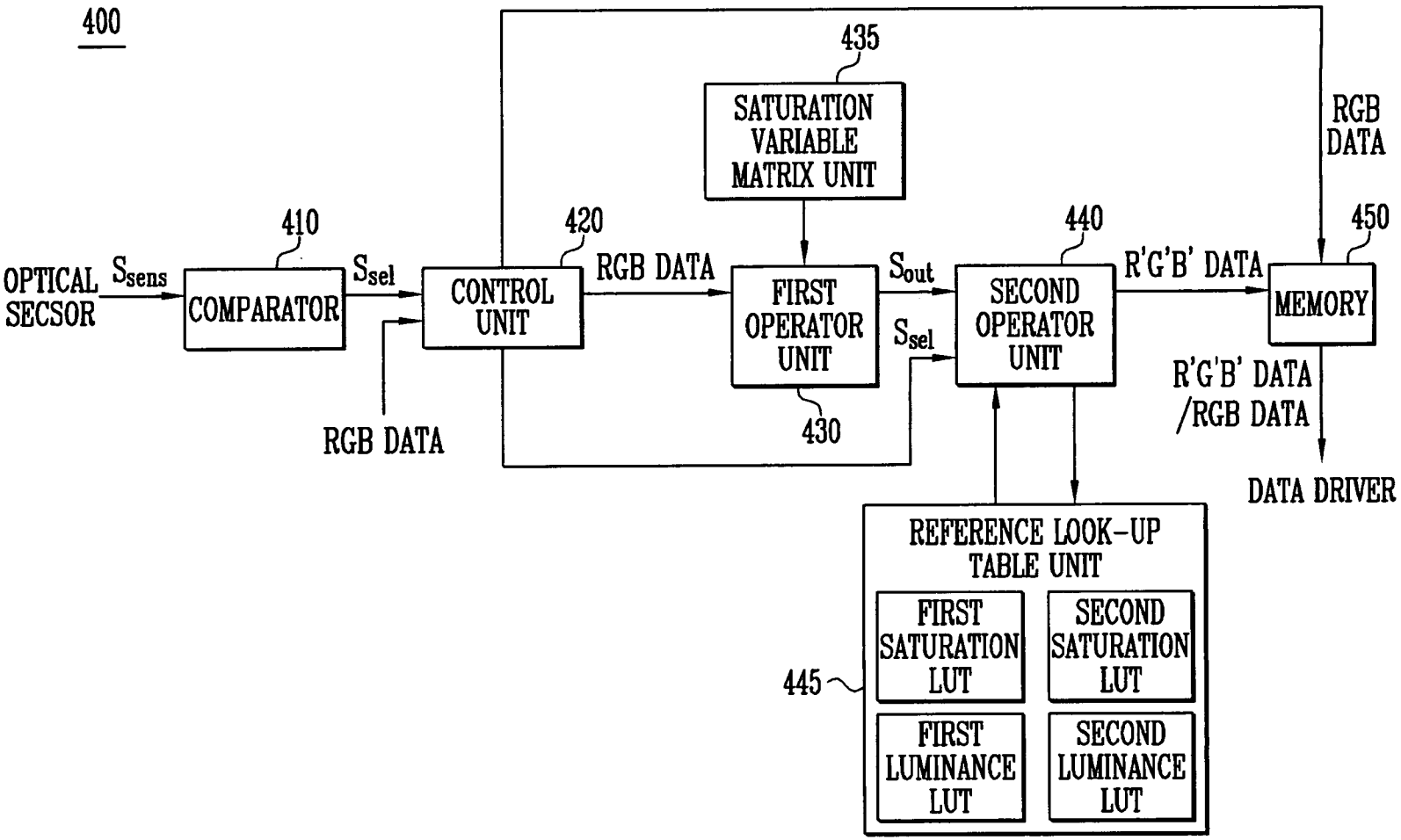
FIG. 2 illustrates a schematic view of an exemplary data conversion unit as shown in FIG. 1.

Referring to FIG. 2, the data conversion unit 400 may include a comparator 410, a control unit 420, a first operator unit 430, a saturation variable matrix unit 435, a second operator unit 440, a reference look-up table unit 445 and a memory 450. Other devices and/or elements may be included or excluded in the data conversion unit 400.

The comparator 410 may compare the predetermined reference value with the optical sensor signal (Ssens) supplied from the optical sensor 500 and may output the selection signal (Ssel) for selecting one of at least three modes. The comparator 410 may set at least three modes on the basis of the predetermined reference value, which may correspond to the intensity of the optical sensor signal (Ssens). The comparator 410 may also set more or less modes besides three modes.

In a first mode, the optical sensor signal (Ssens) may correspond to a minimum value of the predetermined reference value, i.e., weakest intensity of ambient light. Accordingly, the initial input image data (RGB Data) may not be changed in the first mode. The comparator 410 may therefore output the selection signal (Ssel) corresponding to the first mode.

In a second mode, the optical sensor signal (Ssens) may correspond to a maximum value of the predetermined reference value, i.e., largest intensity of ambient light. Accordingly, the initial input image data (RGB Data) may be changed so as to control the saturation and/or luminance in the second mode. The comparator 410 may therefore output the selection signal (Ssel) corresponding to the second mode.

In a third mode, the optical sensor signal (Ssens) may correspond to a value between the maximum value and the minimum value of the predetermined reference value. Accordingly, the initial input image data (RGB Data) may be changed so as to control the saturation and/or luminance in the third mode. The comparator 410 may therefore output the selection signal (Ssel) corresponding to the third mode. Further, the changed input image data (RGB Data) in the third mode may be set to a lower value than the second mode.

The selection signal (Ssel) output from the comparator 410 (in at least one mode) may then be input to the control unit 420. The control unit 420 may determine whether or not to change the initial input image data (RGB Data), so as to correspond to the selection signal (Ssel) input from the comparator 410.

The control unit 420 may transmit the initial input image data (RGB Data) to the first operator unit 430 or, alternatively, may transmit the initial input image data (RGB Data) to be stored in the memory 450. The transmission to the first operator unit 430 or to the memory 450 may depend on whether or not the initial input image data (RGB Data) is changed.

In an implementation, the control unit 420 may store the initial input image data (RGB Data) in the memory 450 if the intensity of the ambient light is a weak, e.g., the selection signal (Ssel) corresponding to the first mode is supplied. If, however, the selection signal (Ssel) corresponds to the second mode or the third mode, the control unit 420 may transmit the initial input image data (RGB Data) to the first operator unit 430.

The first operator unit 430 may perform an operation by using a saturation variable matrix A to generate a pixel saturation data (Sout) corresponding to the initial input image data (RGB Data) transmitted from the control unit 420. The first operator unit 430 may perform an operation on an input data (Rin, Gin, Bin) and the saturation variable matrix A in each of the subpixels, which may be included in the initial input image data (RGB Data). The first operator unit 430 may further calculate a desired saturation data (Rs, Gs, Bs) in every subpixel and may use the calculated saturation data (Rs, Gs, Bs) to generate the pixel saturation data (Sout).

A method of calculating the desired saturation data (Rs, Gs, Bs) in every subpixel will be described later as illustrated in FIG. 3A to FIG. 3D.

The pixel saturation data (Sout) may be calculated from the desired saturation data (Rs, Gs, Bs) in every subpixel. For example, the pixel saturation data (Sout) may be set to the maximum value of the desired saturation data (Rs, Gs, Bs) in every subpixel, or set to a predetermined value corresponding to a difference between the maximum value and the minimum value of the desired saturation data (Rs, Gs, Bs) in every subpixel.

The pixel saturation data (Sout) generated in the first operator unit 430 may then be supplied to the second operator unit 440. The second operator unit 440 may extract the changed input image data (R'G'B' Data) from the reference look-up table unit 445 so as to correspond to the pixel saturation data (Sout) and the selection signal (Ssel) supplied from the first operator unit 430 and the control unit 420, respectively. The second operator unit 440 may further store the extracted changed input image data (R'G'B' Data) in the memory 450.

The second operator unit 440 may select one of a first saturation and luminance look-up tables (LUTs) and a second saturation and luminance LUTs provided in the reference look-up table unit 445 to correspond to the selection signal (Ssel). The second operator unit 440 may extract the changed data (R'G'B' Data) from the selected LUTs, so that the changed data (R'G'B' Data) having the saturation and luminance values may correspond to the pixel saturation data (Sout). The saturation LUTs and the luminance LUTs may represent tables to extract a saturation change value and a luminance change value, respectively. The first saturation and luminance LUTs and the second saturation and luminance LUTs may store different saturation and luminance values to correspond to the pixel saturation data (Sout). For example, the first saturation and luminance LUTs, selected by the selection signal (Ssel) in selecting the third mode, may be set to have lower saturation and/or luminance values than the second saturation and luminance LUTs selected by the selection signal (Ssel) in selecting the second mode.

Further, the second operator unit 440 may extract the changed input image data (R'G'B' Data) by referring to two values of the pixel saturation data (Sout) out of the values stored in the reference look-up table unit 445. For example, the second operator unit 440 may extract the changed input image data (R'G'B' Data) by linearly interpolating between a maximum value out of smaller values of the input pixel saturation data (Sout) and a minimum value out of larger values of the input pixel saturation data (Sout).

The memory 450 may store the initial input image data (RGB Data) transmitted from the control unit 420, or the changed input image data (R'G'B' Data) supplied from the second operator unit 440. The initial input image data (RGB Data) or the changed data (R'G'B' Data) stored in the memory 450 may be input to the data driver 300.

FIG. 3A to FIG. 3D illustrate matrices of a desired saturation data in a subpixel calculated in the first operator unit 430 by using the saturation variable matrix A.

Referring to FIG. 3A to FIG. 3D, the first operator unit 430 may calculate the desired saturation data (Rs, Gs, Bs) in every subpixel by multiplying each of the input data (Rin, Gin, Bin) and the saturation variable matrix A in every subpixel.

The saturation variable matrix A may be a matrix for controlling the saturation by using a saturation coefficient factor (k) to determine a saturation adjustment. Further, the saturation may be used to calculate each of the desired saturation data (Rs, Gs, Bs) in every subpixel by changing values of the input data (Rin, Gin, Bin) in every subpixel through a previously selected saturation coefficient (k).

The saturation variable matrix A may be selected according to a white balance of the pixels. In other words, the first operator unit 430 may calculate the desired saturation data (Rs, Gs, Bs) in every subpixel by multiplying the saturation variable matrix A and the input data (Rin, Gin, Bin) in every subpixel (as illustrated in FIG. 3B).

Further, the saturation may be increased if the saturation coefficient factor (k) has a larger value than 1 and, alternatively, may be decreased if the saturation coefficient factor (k) has a smaller value than 1. When the saturation coefficient factor (k) has a value of 1, then the saturation may remain the same, i.e., unchanged, because the saturation variable matrix A is a 3×3 unit matrix (as illustrated in FIG. 3C). When the saturation coefficient factor (k) has a value of 0, then the desired saturation data (Rs, Gs, Bs) in every subpixel may be changed into a saturation-free grey image because the desired saturation data (Rs, Gs, Bs) in every subpixel may be set to the same ratio as the white balance (as illustrated in FIG. 3D).

Referring back to FIG. 2, if the optical sensor signal (Ssens) corresponding to the intensity of ambient light is input from the optical sensor 500 to the comparator 410, the comparator 410 may compare the optical sensor signal (Ssens) to the predetermined reference value to generate the selection signal (Ssel) for selecting at least one of three modes. In other words, the selection signal (Ssel), which may be a signal for controlling the data change, may divide a value in which the optical sensor signal (Ssens) corresponds into at least one of three modes. In particular, the selection signal (Ssel) may be set to select: a) the first mode, if the optical sensor signal (Ssens) corresponds to a weak intensity of ambient light; b) the second mode, if the optical sensor signal (Ssens) corresponds to a large intensity of ambient light; and c) the third mode, if the optical sensor signal (Ssens) corresponds to a value between the weak and large intensity of ambient light. The first mode may be a mode for setting the input image data (RGB Data) to remain the same, e.g., unchanged, and the second and third modes may be modes for changing the input image data (RGB Data).

Now an operation for driving the data conversion unit 400 will be discussed in detail.

Figure 4:
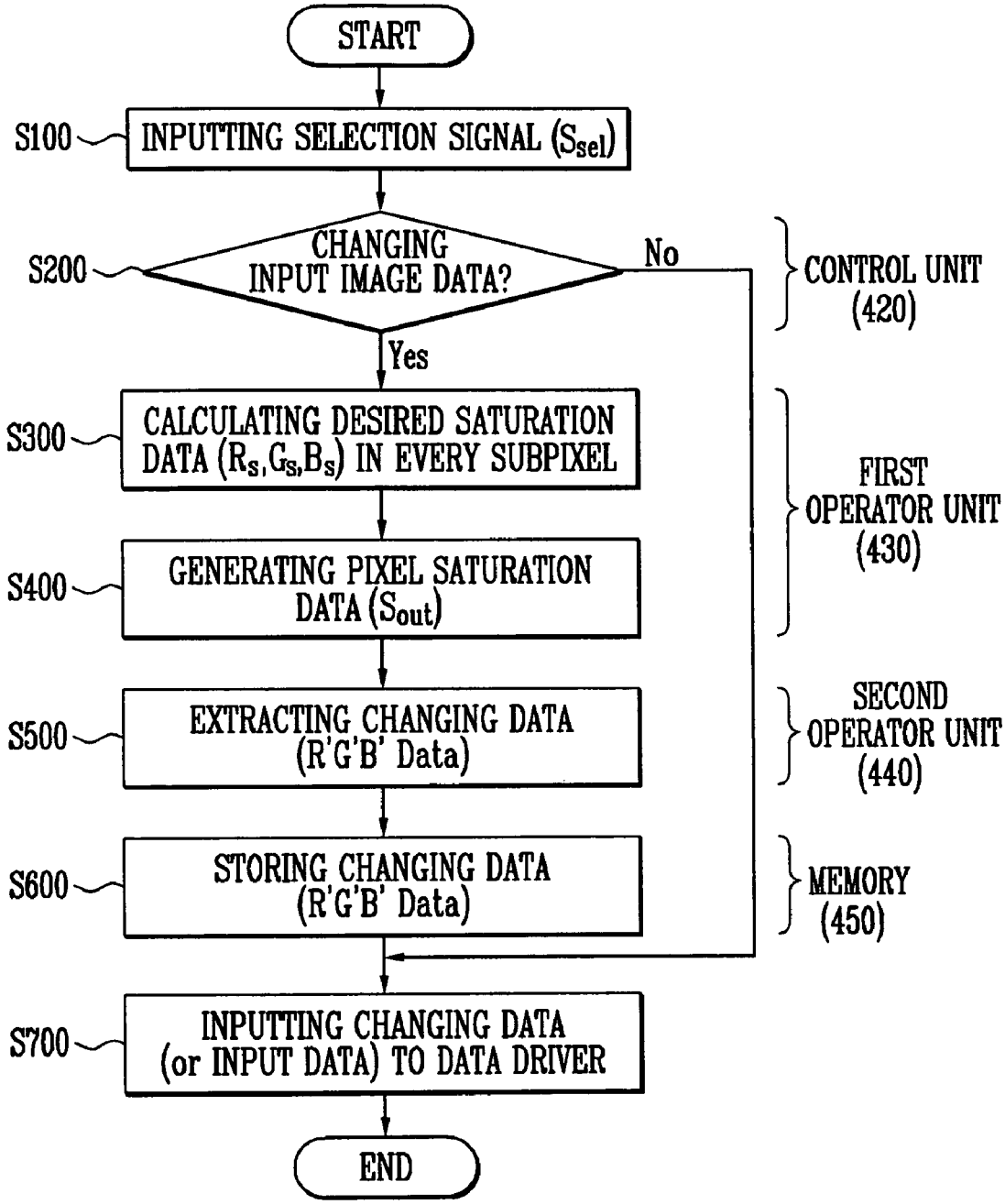
FIG. 4 illustrates a flow chart of a method for driving a data conversion unit as shown in FIG. 2.

Referring to FIG. 4, in S100, the selection signal (Ssel) generated in the comparator 410 may be input to the control unit 420.

In S200, the control unit 420 receiving the selection signal (Ssel) may determine whether or not to change the initial input image data (RGB Data), so as to correspond to the selection signal (Ssel). Accordingly, if the selection signal (Ssel) selects the first mode and inputs to the control unit 420, the control unit 420 may supply the initial input image data (RGB Data) to the data driver 300 without changing the initial input image data (RGB Data). Further, the initial input image data (RGB Data) may be temporarily stored in the memory 450 by the control unit 420 and then input to the data driver 300.

Further, the control unit 420 may transmit the initial input image data (RGB Data) to the first operator unit 430, or may alternatively transmit the received selection signal (Ssel) to the second operator unit 440 (if the selection signal (Ssel) for selecting the second or third mode is input to the control unit 420).

In S300, the first operator unit 430 may calculate the desired saturation data (Rs, Gs, Bs) in every subpixel by carrying out an operation on the initial input image data (RGB Data) and the saturation variable matrix A.

In S400, the first operator unit 430 may further generate a pixel saturation data (Sout) corresponding to the initial input image data (RGB Data) and the saturation variable matrix A. The first operator unit 430 may also supply the generated pixel saturation data (Sout) to the second operator unit 440.

In S500, the second operator unit 440 may then extract the changed input image data (R'G'B' Data) to change the saturation and/or luminance of the initial input image data (RGB Data) from the reference look-up table unit 445. The second operator unit 440 may also store the extracted changed data (R'G'B' Data) in the memory 450 to correspond to the selection signal (Ssel) and the pixel saturation data (Sout). In particular, the second operator unit 440 may select at least one of the two saturation and luminance LUTs stored in the reference look-up table unit 445 and may extract the changed input image data (R'G'B' Data) from the selected look-up table to correspond to the selection signal (Ssel).

If the changed input image data (R'G'B' Data) corresponding to the pixel saturation data (Sout) supplied from the first operator unit 430 is not stored in the reference look-up table unit 445, then the second operator unit 440 may extract the changed input image data (R'G'B' Data) corresponding to the pixel saturation data (Sout) using linear interpolations. The extracted changed input image data (R'G'B' Data) may be stored in the memory 450, in S600.

In S700, the changed input image data (R'G'B' Data) stored in the memory 450 may be input to the data driver 300 and then used to generate a data signal.

Example embodiments relate to an OLED display device and driving methods thereof, having improved visibility by changing input image data to correspond to surrounding environments, e.g., intensity of ambient light. The OLED display device and driving methods thereof may further improve visibility under ambient light by generating a changed input image data to enhance saturation and the like. The OLED display device and driving methods thereof may further improve visibility under ambient light by displaying images corresponding to a generated changed input image data when the OLED display device is exposed to ambient light having a greater illumination intensity value than a predetermined reference value. The OLED display device and driving methods thereof may further improve response to intensity of ambient light by selecting at least one of three modes for controlling an input image data to be changed.

Example embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting diode display device, comprising:

a pixel unit including a plurality of pixels connected to scan lines and data lines;

a scan driver adapted to generate and supply scan signals to the scan lines;

a data driver adapted to generate and supply data signals to the data lines;

an optical sensor adapted to generate an optical sensor signal corresponding to an intensity of light; and a data conversion unit adapted to compare a predetermined reference value with the optical sensor signal so as to generate a selection signal for selecting one of at least three modes, the data conversion unit is adapted to store an input image data or a changed input image data to correspond with the selection signal, wherein the data driver is adapted to generate the data signals to correspond to the input image data or the changed input image data stored in the data conversion unit, wherein the data conversion unit further includes:

a comparator;

a control unit adapted to determine changing the input image data to correspond to the selection signal;

a first operator unit adapted to generate a pixel saturation data to correspond to the input image data transmitted from the control unit;

a second operator unit adapted to extract the changed input image data to correspond to the pixel saturation data and the selection signal; and a memory adapted to store the input image data transmitted from the control unit or the changed input image data supplied from the second operator unit.

2. The OLED display device as claimed in claim 1, wherein, in a first mode, the control unit is adapted to store the input image data in the memory if the selection signal indicates a weak intensity of light.

3. The OLED display device as claimed in claim 1, wherein, in a second mode, the control unit is adapted to transmit the input image data to the first operator unit and adapted to transmit the selection signal to the second operator unit if the selection signal indicates a large intensity of light.

4. The OLED display device as claimed in claim 3, wherein, in a third mode, the control unit is adapted to transmit the input image data to the first operator unit and adapted to transmit the selection signal to the second operator unit if the selection signal indicates a value between the weak intensity of light and the large intensity of light.

5. The OLED display device as claimed in claim 4, wherein the changed input image data in the third mode is set to a lower value than the second mode.

6. The OLED display device as claimed in claim 1, wherein the first operator unit is adapted to perform an operation using a saturation variable matrix.

7. The OLED display device as claimed in claim 6, wherein the first operator unit is adapted to calculate a desired saturation data in every subpixel by performing an operation on an input data in the input image data and the saturation variable matrix in every subpixel.

8. The OLED display device as claimed in claim 1, further comprising a reference look-up table unit calculated by the second operator unit, the reference look-up table unit includes a first saturation and luminance look-up tables and a second saturation and luminance look-up tables.

9. The OLED display device as claimed in claim 8, wherein the second operator unit is adapted to select one of the first saturation and luminance look-up tables and the second saturation and luminance look-up tables to correspond to the pixel saturation data and the selection signal, and adapted to extract the changed input image data from the selected look-up tables.

10. The OLED display device as claimed in claim 9, wherein the second operator unit is adapted to extract the changed input image data by linearly interpolating between two values of the pixel saturation data stored in the reference look-up table unit, if the pixel saturation data that is not stored in the reference look-up table unit is input.

11. A method for driving an organic light emitting diode display device, comprising:

supplying scan signals to scan lines generated by a scan driver;

supplying data signals to data lines generated by a data driver;

generating an optical sensing signal corresponding to an intensity of light sensed on an optical sensor;

generating a selection signal for selecting one of at least three modes to correspond to the intensity of light;

storing an input image data or a changed input image data to correspond with the selection signal, determining whether to change the input image data to correspond to the selection signal; and extracting data when the changed input image data is determined, the changed data being obtained by changing at least one of a saturation and a luminance of the input image data, wherein extracting the changed input image data further includes:

generating a pixel saturation data from the input image data, extracting the changed input image data from a reference look-up table unit to correspond to the pixel saturation data and the selection signal, and extracting the changed input image data by linearly interpolating between two values of the pixel saturation data among values stored in the reference look-up table unit if the pixel saturation data not stored in the reference look-up table unit is input, wherein generating the pixel saturation data further includes:

calculating a desired saturation data in every subpixel by performing an operation on the input image data and the saturation variable matrix; and generating the pixel saturation data to correspond to the desired saturation data in every subpixel wherein the data driver generates the data signals to correspond to the input image data or the changed input image data stored in a data conversion unit.

12. The method for driving the OLED display device as claimed in claim 11, further comprising selecting a signal for selecting a mode in the selection signal corresponding to a weak intensity of light, so that the input image data remains unchanged.

13. The method for driving the OLED display device as claimed in claim 11, further comprising selecting a signal for selecting a mode in the selection signal corresponding to a large intensity of light, so as to change the input image data.

14. The method for driving the OLED display device as claimed in claim 11, further comprising storing the input image data and generating a data signal corresponding to the stored input image data.

* * * * *